US006599003B2

(12) United States Patent
Hou et al.

(10) Patent No.: US 6,599,003 B2
(45) Date of Patent: Jul. 29, 2003

(54) LED DISPLAY

(75) Inventors: Huai Te Hou, Taipei Hsien (TW); Ching Tsung Chien, Taipei Hsien (TW); Chaoming Wu, Taipei Hsien (TW)

(73) Assignee: Lite-On Electronics, Inc., Taipei Hsien (TW)

( * ) Notice: Subject to any disclaimer, the term of this patent is extended or adjusted under 35 U.S.C. 154(b) by 0 days.

(21) Appl. No.: 09/977,322

(22) Filed: Oct. 16, 2001

(65) Prior Publication Data

US 2003/0072168 A1 Apr. 17, 2003

(51) Int. Cl.[7] ..... G09F 13/18

(52) U.S. Cl. ..... 362/559; 362/545; 362/800; 345/33; 40/451

(58) Field of Search ..... 362/555, 559, 362/545, 800, 812; 313/510, 511, 512; 345/33–34; 40/450, 453

(56) References Cited

U.S. PATENT DOCUMENTS 5,812,102 A * 9/1998 Sprole et al. ..... 345/34
6,307,527 B1 * 10/2001 Youngquist et al. ..... 257/676

* cited by examiner

*Primary Examiner*—Sandra O'Shea
*Assistant Examiner*—Ali Alavi
(74) *Attorney, Agent, or Firm*—Rosenberg, Klein & Lee

(57) ABSTRACT

An LED display comprises a reflective panel and a segment structure on the reflective panel. The segment structure includes a plurality of segments for forming digit, text, symbol and graph and decimal point for the LED display. Each segment comprises a plurality of light dots, the number and shape and factor of the light dots are not limited and can be varied according to practical requirement. The LED display has performance and effect compatible to the VFD and advantages such as simple manufacture process, reduced materials, reduced cost, high yield and enhanced quality.

1 Claim, 4 Drawing Sheets

LED DISPLAY

FIELD OF THE INVENTION

The present invention relates to an LED (light emitting diode) display, especially to an LED display with performance compatible with that of the VFD (vacuum fluorescent display) device.

BACKGROUND OF THE INVENTION

There are bountiful flat panel displays available in current market. For example, the VFD (vacuum fluorescent display) is a kind of flat panel display with principle similar to CRT (cathode ray tube) but having smaller driving voltage. In this device, electrons are generated by cathode, controlled by grid and accelerated by anode of the VFD. The accelerated electrons strike a phosphor coated on the anode to generate luminescent light. The VFD is an active device and extensively used in high-end appliance and instrument.

FIGS. 1 and 2 show the exploded view and sectional view of a VFD. As shown in these figures, a VFD mainly comprises a faceplate 60, a phosphor 62, a glass substrate 63, an insulative layer 64, a plurality of anodes 65, a plurality of filaments 66, a plurality of grids 67 and a plurality of wirings 68.

The above-mentioned VFD has excellent visual effect. However, the price thereof is also high due to expensive components, cumbersome manufacture and poor yield.

Moreover, the VFD for compact textual and graphic display also has the disadvantages of short life, poor mechanical robustness, decayed brightness and high cost.

SUMMARY OF THE INVENTION

It is the object of the present invention to provide an LED display with performance compatible with that of the VFD (vacuum fluorescent display) device.

In one aspect of the present invention, the LED display comprises a reflective panel and a segment structure on the reflective panel. The segment structure includes a plurality of segments for forming digit, text, symbol and graph and decimal point for the LED display. Each segment comprises a plurality of light dots, the number and shape and factor of the light dots are not limited and can be varied according to practical requirement.

In another aspect of the present invention, the LED display can prevent the disadvantages of the VFD device such as short life, poor mechanical robustness, decayed brightness and high cost and provides advantages such as simple manufacture process, reduced materials, reduced cost, high yield and enhanced quality.

The various objects and advantages of the present invention will be more readily understood from the following detailed description when read in conjunction with the appended drawing, in which:

DETAILED DESCRIPTION OF THE INVENTION

Figure 1:
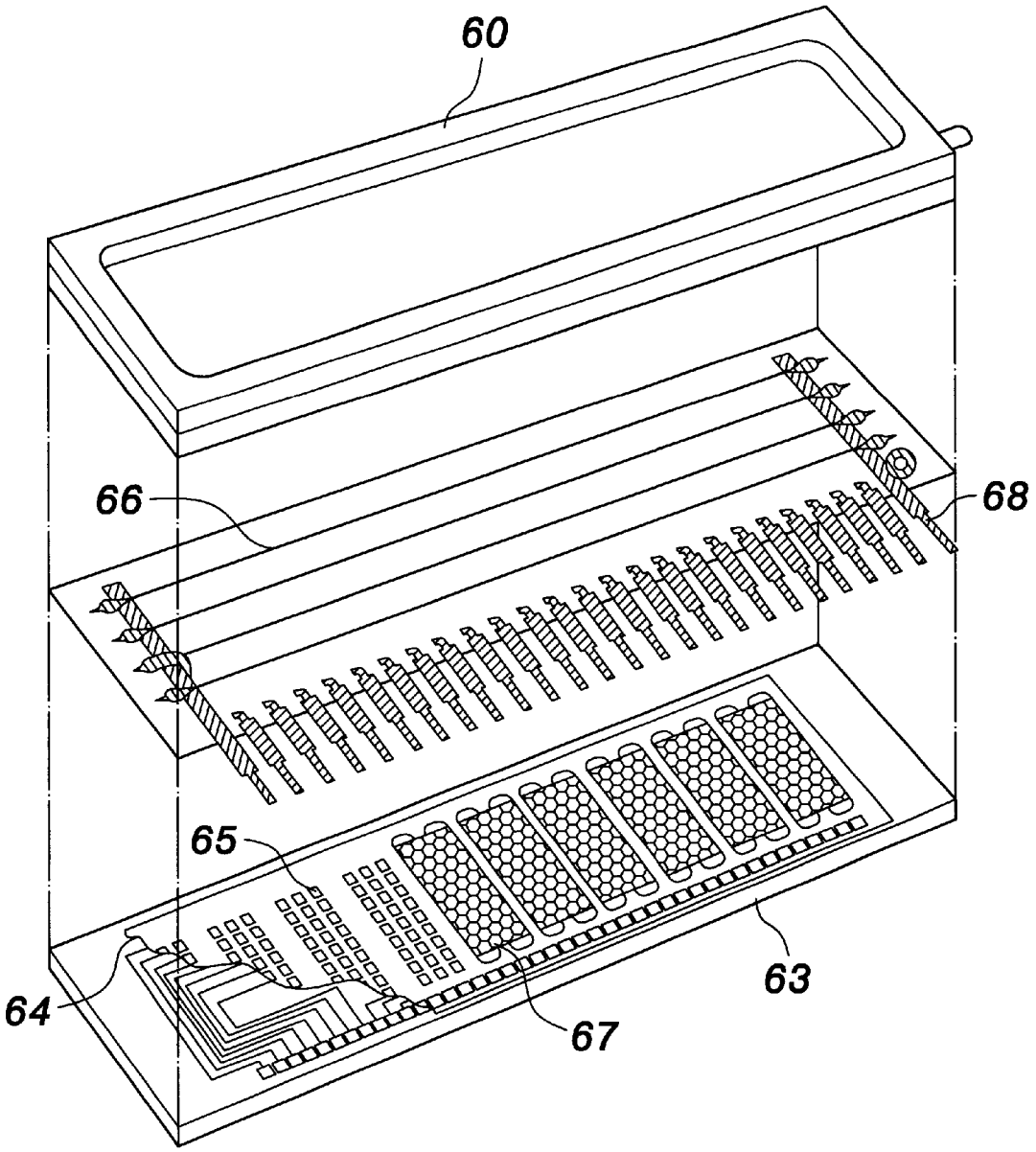
FIG. 1 PRIOR ART
FIG. 1 shows an exploded view of a conventional VFD device.
Figure 2:
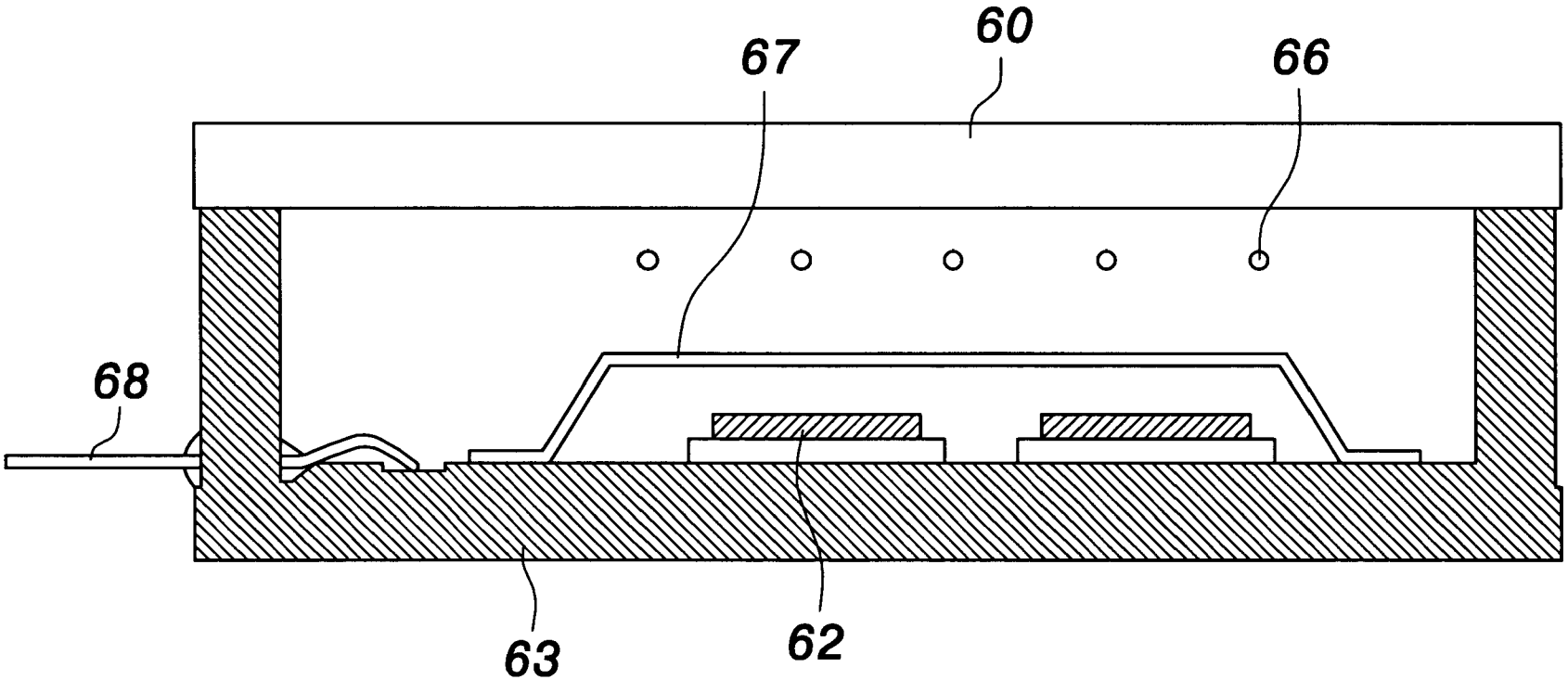
FIG. 2 PRIOR ART
FIG. 2 shows a sectional view of a conventional VFD device.
Figure 3:
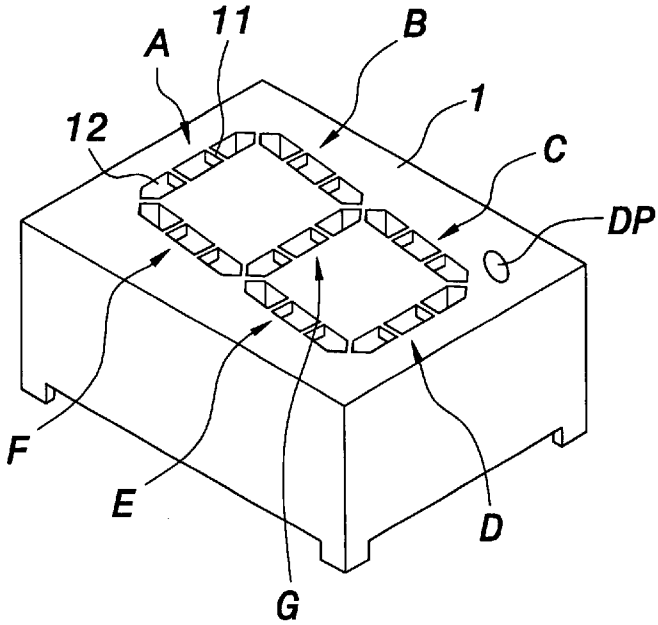
FIG. 3 shows a perspective view of an LED display according to the present invention.

FIG. 3 shows a perspective view of an LED display according to the present invention. The LED display comprises a segment structure on a reflective panel 1. The segment structure includes a plurality of segments for forming digit, text, symbol and graph and decimal point (DP). The present invention is exemplified with a seven-segment structure (segments A to G). Each segment comprises a plurality of light dots 11. The number, shape and form factor of the light dots 11 are not limited and can be varied according to practical requirement. When the light emitting elements (not shown) are driven by DC or pulse voltage, the light is emitted through a plurality of windows 12 of the light dots 11.

Figure 4:
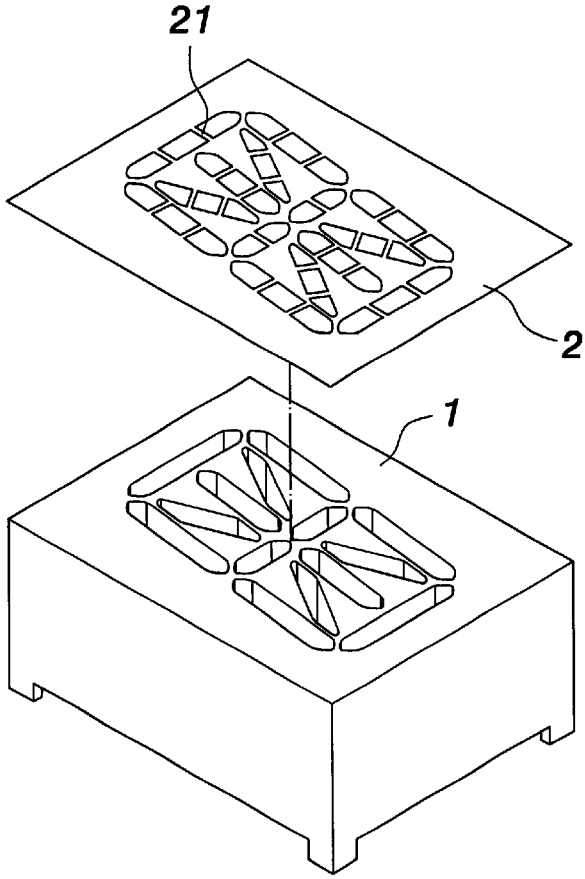
FIG. 4 shows an exploded view of the LED display according to another preferred embodiment of the present invention, wherein a print tape is incorporated.

FIG. 4 shows an exploded view of the LED display according to another preferred embodiment of the present invention. The LED display comprises a reflective panel 1 as in prior art and a print tape 2 for representing digit, text, symbol and graph and pasted on the reflective panel 1. The print tape 2 is composed of a plurality of light dots 21.

Figure 5:
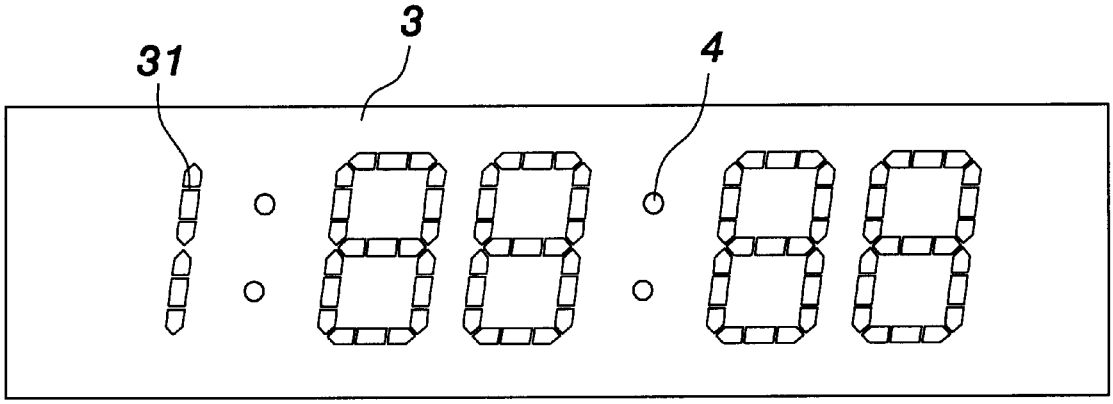
FIG. 5 shows the application of the present invention.

FIG. 5 shows the application of the preferred embodiment in FIG. 4. The inventive LED display is applied in an instrument panel 3. The instrument panel 3 is provided with digits formed by one set of two-segment structure, four sets of seven-segment structure and two colon symbols 4. Each segment comprises a plurality of light dots 31.

To sum up, the LED display according to the present invention has following advantages:

1. Performance and effect compatible to the VFD.
2. Simple manufacture process.
3. Reduced materials.
4. Reduced cost.
5. High yield.
6. Enhanced quality.

Although the present invention has been described with reference to the preferred embodiment thereof, it will be understood that the invention is not limited to the details thereof. Various substitutions and modifications have suggested in the foregoing description, and other will occur to those of ordinary skill in the art. For example, the light-emitting element can be dies of LEDs or packaged LED such as surface mount LED. Therefore, all such substitutions and modifications are intended to be embraced within the scope of the invention as defined in the appended claims.

We claim:

1. An LED display comprising a reflective panel having a plurality of light emitting elements disposed therein; and a print tape for representing digits, text, symbols and graphics, said print tape being pasted onto the reflective panel and being formed with a plurality of light transmissive regions disposed in respective correspondence with the plurality of light emitting elements.

* * * * *